US005547273A

United States Patent [19]

Hudnall

[11] Patent Number: 5,547,273

[45] Date of Patent: Aug. 20, 1996

[54] ROTARY FILE AND STORAGE CABINET

[76] Inventor: Walter E. Hudnall, R.R. #2 Box 173, Nowata, Okla. 74048

[21] Appl. No.: 523,463

[22] Filed: Sep. 5, 1995

[51] Int. Cl.[6] ..... A47B 88/00

[52] U.S. Cl. ..... 312/305; 312/249.2

[58] Field of Search ..... 312/305, 287, 312/249.2, 249.7, 267

[56] References Cited

U.S. PATENT DOCUMENTS

| | | | |
|---|---|---|---|
| 3,868,157 | 2/1975 | Robinson | 312/305 |
| 4,300,809 | 11/1981 | Brownceg | 312/249.2 |
| 4,509,676 | 4/1985 | Stacy | 312/305 |
| 5,321,181 | 5/1994 | Hudnall | 312/305 |

*Primary Examiner*—Peter M. Cuomo
*Assistant Examiner*—Gerald A. Anderson
*Attorney, Agent, or Firm*—Francis X. LoJacono

[57] ABSTRACT

A rotary file cabinet defined by a base member on which is mounted a cabinet housing having two oppositely disposed access openings, wherein each opening is defined by a pair of support posts on which is mounted a canopy, wherein an improved rotary file assembly is rotatably mounted in the file cabinet and comprises an intermediate partition in which is formed a coaxial axle housing adapted to house an axle assembly that includes a central axle fixedly positioned between the canopy and the base member, whereby the rotary file assembly can be selectively positioned between an open or closed mode.

18 Claims, 10 Drawing Sheets

10
50
20
28
12
42
18
17
27
139
102
136
35
38
109
110
138
146
140
16
132
139
136
109
169
104
100
32
27
28
70
50
42
50
42
50
40
44
20
12

84
34
70
70
80
33
82
70
70

31
30
86
88
129
7
7
80
75
90
78
8
8
100
14
102
104
110
106
114
108
116
116
92
94
136
132
96
35
85
136
32
70
98
80
82
33
9
9

112
116
78
106
102
108
110
114
100
104

112
78
106
102
104
108
110
114
116
100

ROTARY FILE AND STORAGE CABINET

BACKGROUND OF THE INVENTION

1. Field of the Invention

The present invention relates generally to a rotary file cabinet, and more particularly to a rotary file and/or storage cabinet having a file assembly that includes an improved rotatable support apparatus that is readily rotatable about a vertical axis which provides a stable well-balanced structure so as to support a plurality of various types of shelves and associated members thereto that define two oppositely positioned storage-bay sections during the rotation of the rotary file assembly or structure from one position to another.

2. Description of the Prior Art

The present invention as herein shown and described is an improved version of U.S. Pat. No. 5,312,181 issued to Walter E. Hudnall on May 17, 1994.

Many types of rotary file cabinets are well known in the art; however, there various problems and difficulties that are associated with them, more particularly, the need to provide a suitable means for operating and supporting the many rotatable file structures that are employed in many of the rotary file cabinets. Because of the delicate balance that is required in these rotary file systems they often cause operational limitations that restrict their use, making them unsuitable for extended use due to the inadequate design parameters of their respective rotary support systems or assembles. That is, the average rotatable support system is not adequately designed or constructed to carry heavy loads to be supported within their structures, and this is particularly true when a load is unequally distributed on the shelves within the file bays of the cabinet. Moreover, many of the known commercial rotary file cabinets are not only complicated in their respective constructions but are also sluggish in operation, and thus are often expensive to maintain and operate in an efficient manner.

As examples of some of the known rotary file cabinets one may refer to the following United States patents.

There is disclosed in U.S. Pat. No. 3,868,157 to Gerard A. Robinson a rotary file cabinet which comprises a cabinet having a top cover and a base member which itself forms part of a rotatable bearing unit. The particular arrangement of this unit is often referred to as a lazy-susan and includes an upper bearing plate and a lower bearing plate which are part of the top wall of the base member. Both bearing plates are formed with matching circular ring-shaped separations which together define a ball race for balls, as is well known in the art for this type of bearing structure. Thus, the Robinson's bearing device is the principle supporting means for his rotatable shelf structure as the bearing device is interposed between the base member and the rotary shelf structure which is completely supported by the bearing device. The rotatable shelf structure is held in a vertical alignment by a trunion member defined by an axle pin mounted in the upper cover and which is received in an aligned small bushing and a pivot bolt that is centrally mounted in the bottom of the rotatable shelf structure and affixed to the base member.

Other types of rotary file cabinets having similar flat rotary support bearing units are also disclosed in U.S. Pat. No. 4,229,060; U.S. Pat. No. 4,239,311; U.S. Pat. No. 4,258,966 and U.S. Pat. No. 4,300,809 to Sherwood S. Brownlee, and in U.S. Pat. No. 4,241,964 and U.S. Pat. No. 4,258,966 to Frederick H. Grubb, Jr.

In U.S. Pat. No. 4,928,549 to Frank Potter, there is disclosed a cabinet having a rotary file unit supported by an inner post having an outer hexagon rotatable post on which are mounted a plurality of radial shelves.

SUMMARY OF THE INVENTION

The present invention defines a rotary file cabinet which is adapted to be used as either a single file cabinet or as a group of interconnected side-by-side units arranged in multiples so as to provide a high-volume, high-activity, double-bay file and/or storage system that provides access from either side of each cabinet. Each unit comprises a cabinet housing having a rotary assembly which is rotatably supported on a coaxial support unit which comprises a fixed vertical shaft and a rotatable coaxial housing assembly.

The coaxial housing assembly is rotatably supported by pair of pilot bearing sleeves, one being mounted adjacent the upper end of the fixed shaft and the other being mounted adjacent the lower end of the fixed shaft, and interposed between an elongated shaft defined by the adjoining longitudinal ends of a coaxial housing that is defined by a contiguous two-panel wall structure that forms a partition between the oppositely disposed file bay compartments.

The lower pilot bearing sleeve is supported on a bushing that is supported on a thrust bearing adapted to carry heavy loads in a vertical and stable manner superior to other known rotatable vertical support structures of this variety. This new support arrangement prevents excessive wear on the housing assembly and on the single thrust bearing, particularly when the rotary assembly is placed in an unbalanced condition due to unevenly loaded material stored in the file bay.

A file support frame structure is arranged to include oppositely disposed front and rear closure panels or doors and a pair of oppositely arranged shelf support fixtures that define back-to-back shelving bays which are adapted to receive various shelf arrangements or storage devices that might be needed for the filing and/or storage of articles as well as files.

Positioned above the support base and attached to the bottom of the frame structure is a rotary positioning disk or plate which is provided with at least four detents or recesses formed in the peripheral edge of the disk in which is disposed a spring-loaded latching roller removably received so as to engage the recesses as the file structure is rotated in ninety-degree increments.

The cabinet is preferably rectilinear, whereby two open sides are provided to access the files or store items from either side of the cabinet, as may be required.

Thus, it is an important object of the present invention to provide a file cabinet that includes a rotor assembly that is supported by a small thrust bearing at the bottom of the rotor. This thrust bearing is supported directly by the base assembly, whereby the thrust bearing becomes a fulcrum point. To prevent the rotary assembly from teetering the vertically fixed axle or support shaft of the assembly is fixedly mounted to the central portion of the base member at its lower end, the upper end of the fixed axle being piloted at the top of the rotary by means of a retainer housing that forms part of the canopy top and four supporting post assemblies.

Another object of the invention is to provide the rotary assembly with a central partition that is defined by a pair of panel members so constructed as to form an elongated tubular sleeve or post adapted to receive the fixed axle therein in conjunction with the top and bottom bronze bushings, whereby the rotary assembly is readily and freely rotated about the central axis of the supporting axle so as to define a fixed lateral support for the rotary assembly resulting in a very simple but unique structure.

It should be noted that in the applicant's original rotary file and storage cabinet as disclosed in U.S. Pat. No. 5,312,181 the rotary hung from the top of a fixed axle and was piloted at the bottom with a bronze bushing. This is in itself a satisfactory method but the axle has to be heavier since, by compression the load is transferred to the base. This results in added weight and cost since it requires a larger rotary assembly, creating the need for more floor space from front to back.

Still another object of the present invention is to provide a rotatable file cabinet that includes a rotary assembly that defines oppositely disposed file bays, each being divided by a partition that is formed by two interconnected solid panels of sheet metal attached at their respective outer vertical ends to transverse shelf supporting door panels which, together, define a means to adjustably support shelving mounted within the respective bays.

Another object of the invention is to provide a simple but easy self-operating device, whereby the two front door panels of the rotary assembly can be readily rotated in 90-degree increments from a closed position to an open position, thereby exposing the two oppositely disposed file sections that provide access to the stored files therein.

A further object of the present invention is to provide a rotary support assembly that uses a single-thrust bearing mounted at the bottom of a fixed vertical shaft or axle on which is supported the rotatable shelf assembly, and wherein a pair of pilot bearings are interposed between the fixed shaft and the coaxial rotatable housing that is defined at the interconnecting vertical contiguous edges of the two panels that make up the central partition dividing the two file bays.

A still further object of the present invention is to provide a rotary file cabinet having a very simple frame structure that is easily assembled and rigidly secured so as to support substantial file loads.

It is a further object of the invention to provide a rotary file cabinet of this character that is relatively inexpensive to manufacture, and is simple yet rugged in construction.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts.

DESCRIPTION OF THE PREFERRED EMBODIMENT

Figure 1A:
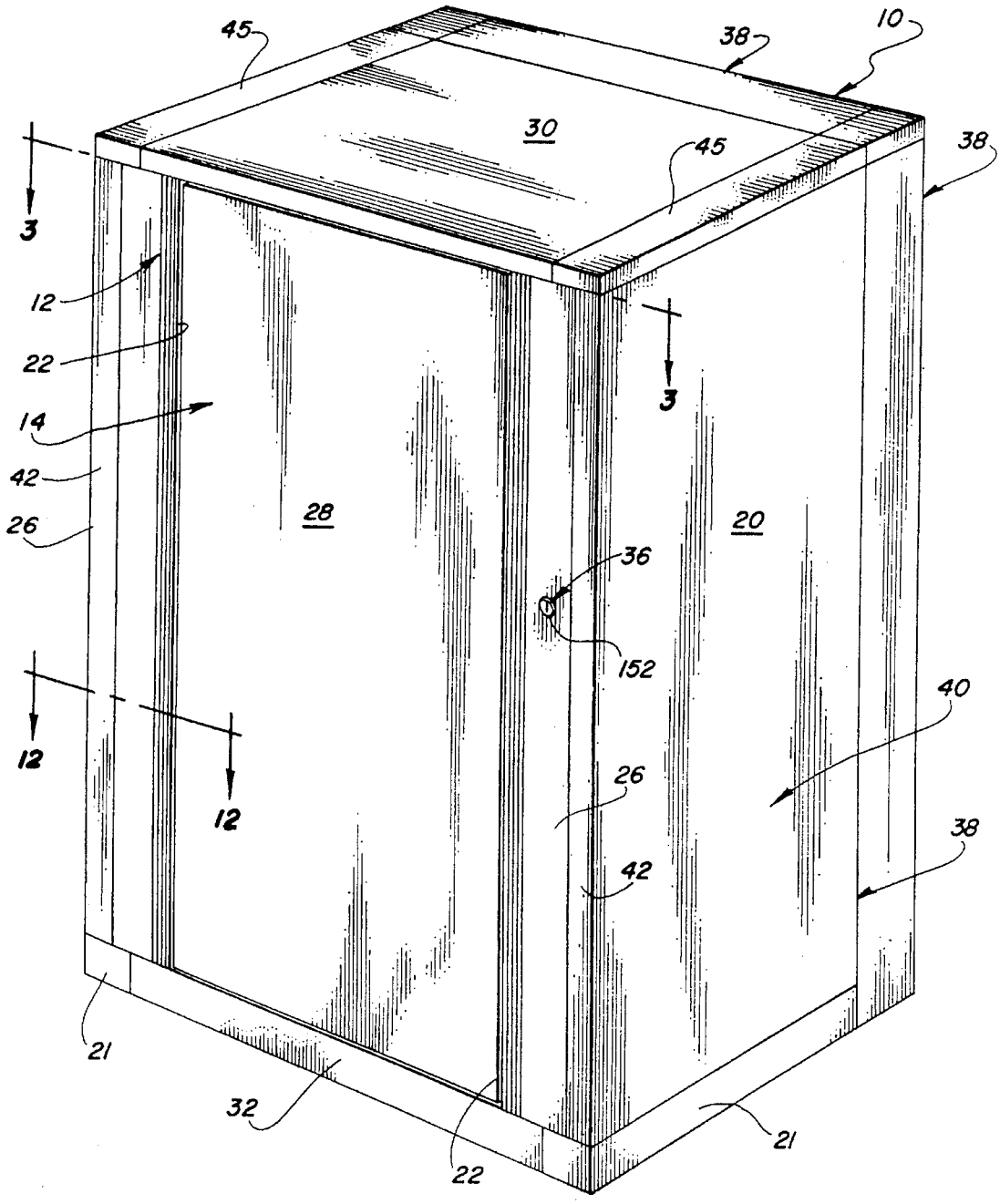
FIG. 1A is a perspective view of the present invention showing a single file cabinet with an internal rotary assembly positioned in a closed mode.

Referring more particularly to FIG. 1A, there is shown a rotary file and/or storage cabinet of the present invention which is generally indicated at 10 and is illustrated in this view as a single unit comprising a cabinet housing 12 having a generally rectangular or square cross-sectional configuration. The cabinet housing which is defined by four rectilinear sides has mounted therein a rotary file assembly, designated at 14. In FIG. 1A, the rotary file assembly is shown positioned in a closed mode while in FIG. 2 the assembly is shown in an open position, wherein the rotary file assembly has been rotated 90 degrees to expose one of the two oppositely positioned double-bay file sections or storage compartments which are more clearly shown in FIG. 3, and generally designated at 16 and 18. It should be noted that typical flat shelves 17 are shown mounted therein.

Figure 1B:
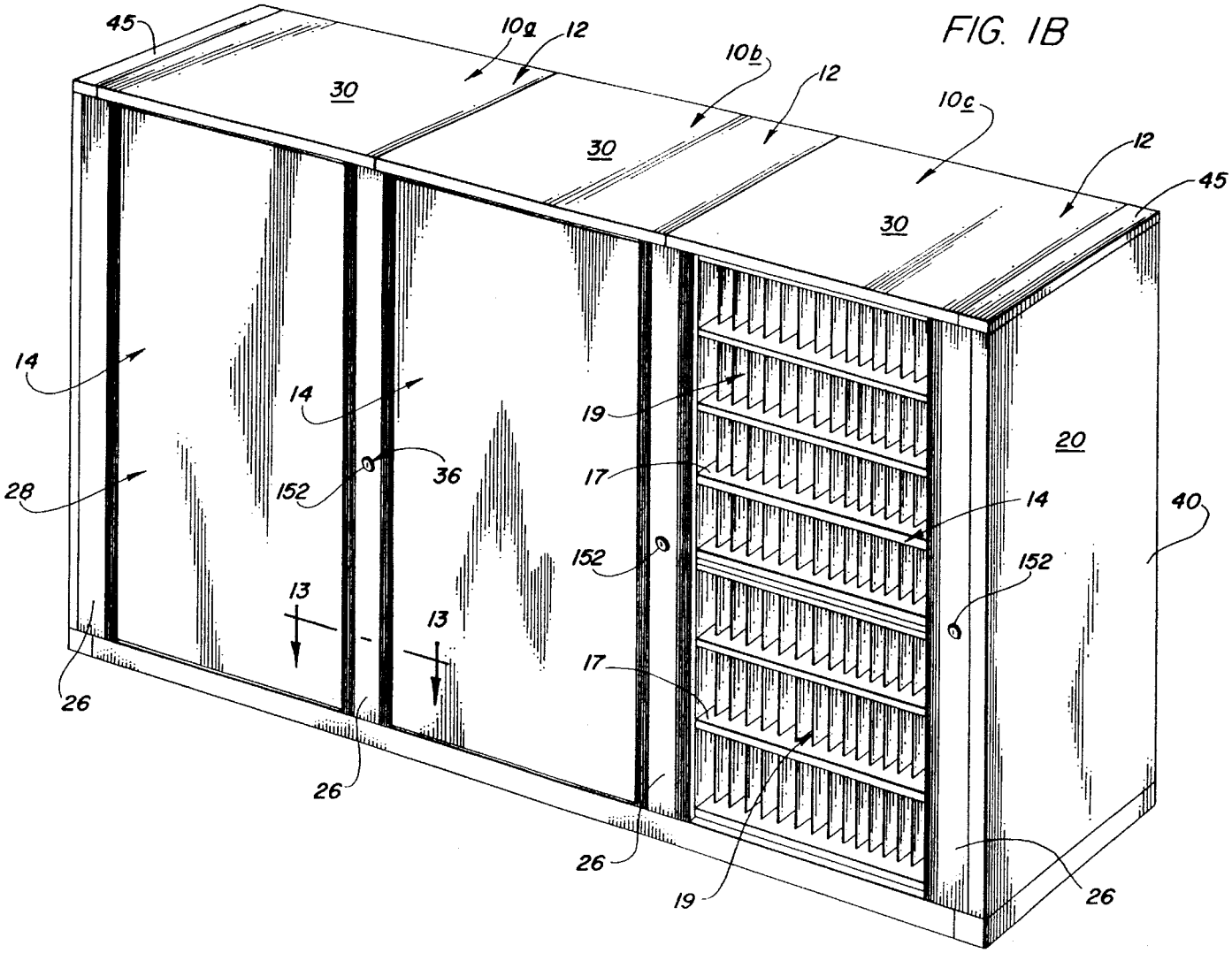
FIG. 1B is a perspective view of the present invention showing a multiplicity of file cabinets interconnected to define a group of file cabinets.

In FIG. 1B there is shown a second embodiment of the present invention, wherein a multiplicity of cabinet units 10*a*, 10*b* and 10*c* are arranged in a contiguous interconnected manner, and wherein each cabinet unit includes an independent rotary file assembly 14 and shelving 17 on which is shown folders as used for lateral filing, indicated at 19. The specific structural arrangement will hereinafter be described in more detail. Thus, for the purpose of simplicity the single cabinet unit 10 will first be described in detail since each of the connected cabinet units is provided with an identical rotary file assembly.

Figure 2:
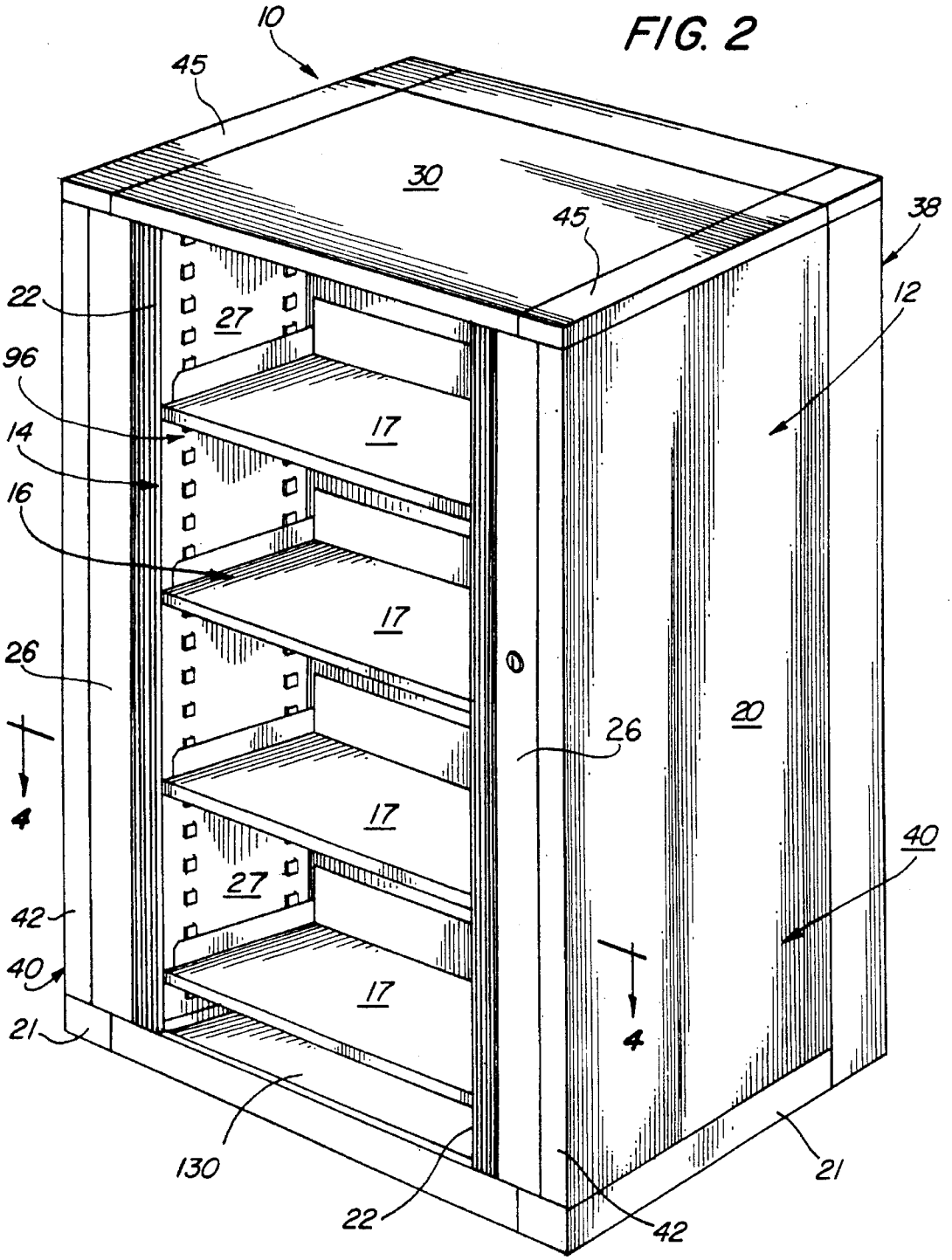
FIG. 2 is a perspective view of the file cabinet similar to that shown in FIG. 1A but in an open mode and illustrating the internally mounted rotary assembly being positioned so as to expose one of the shelving bays.
Figure 3:
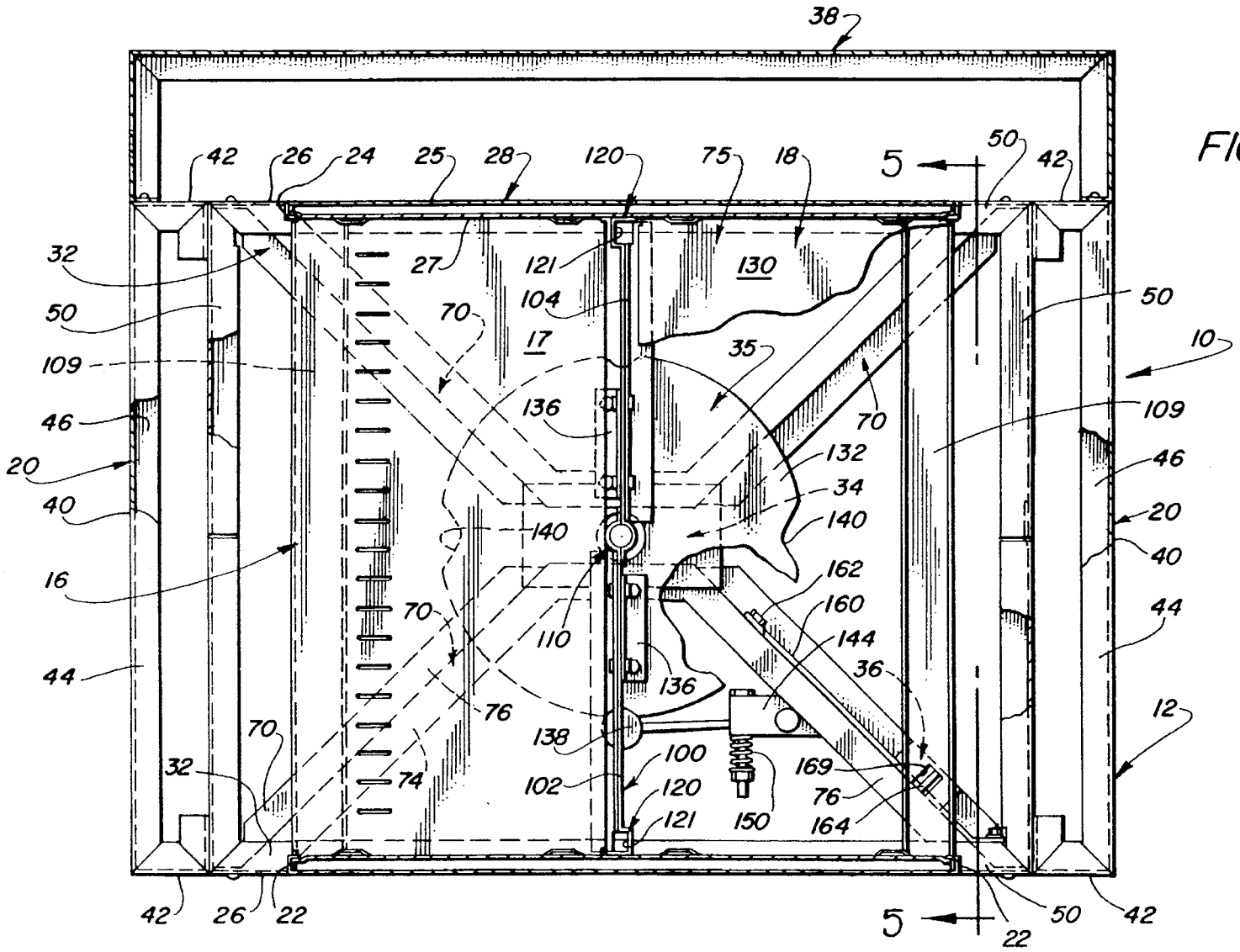
FIG. 3 is an enlarged top view taken substantially along line 3—3 of FIG. 1A illustrating the cabinet with the canopies removed, showing the rotary assembly in the closed position, wherein the double-bay file and/or storage compartments are in a closed position, one of the bottom closure covers being broken away to expose the rotary-positioning apparatus at the base thereof.

Accordingly, in FIGS. 1A, 2, 3 and 4 housing 12 comprises side closure walls 20 and two oppositely disposed access openings 22 and 24 which are each defined by a pair of post assembles 26 arranged to allow closure doors 28, defined by walls 25 and 27, of rotary file assembly 14 to be rotated to a closed position, as illustrated in FIGS. 1A and 3 and hereinafter described in detail.

Figure 4:
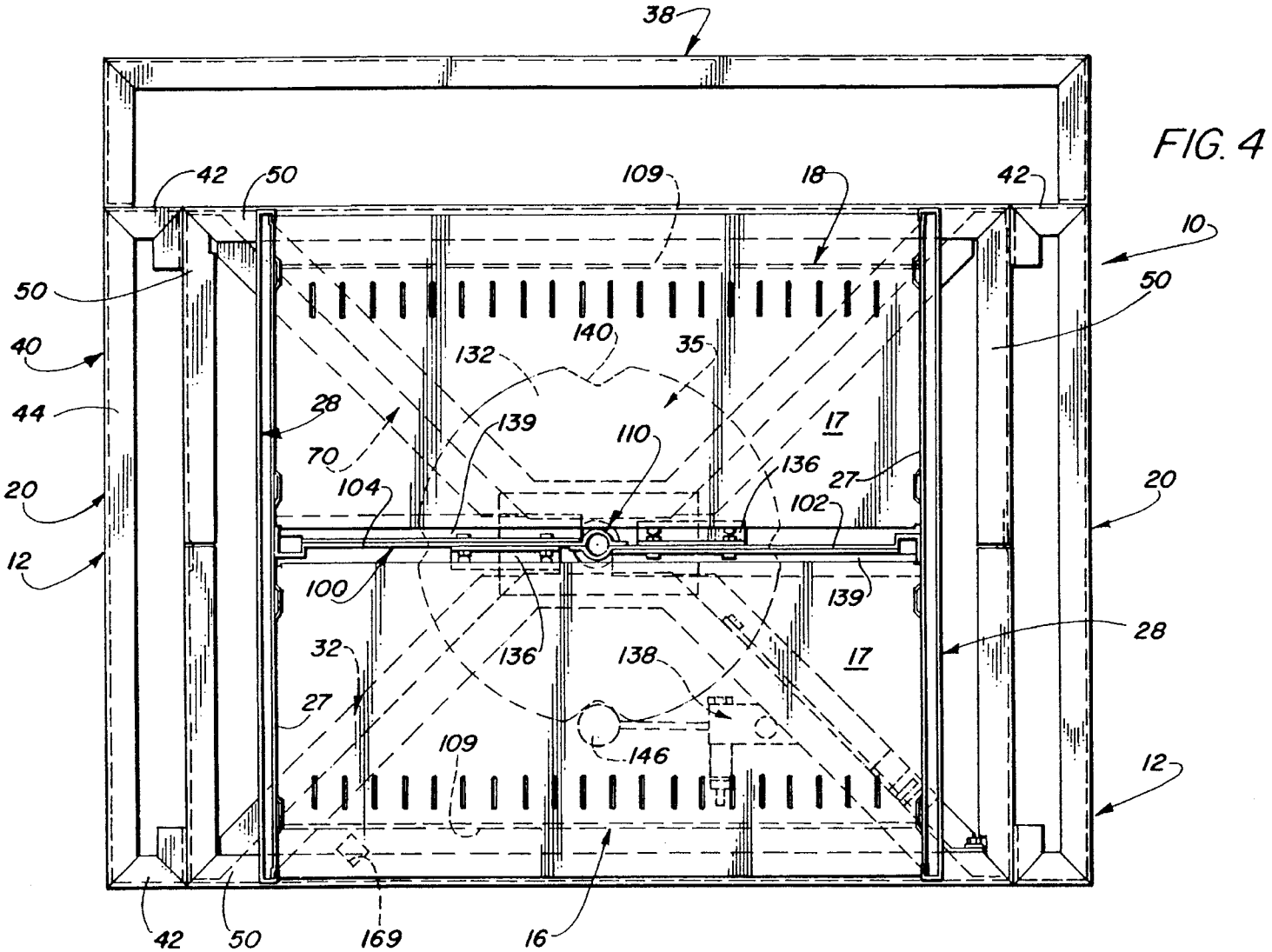
FIG. 4 is an enlarged top view substantially similar to that which is shown in FIG. 3 but showing the rotary assembly rotated ninety degrees to define an open position.

The top of the cabinet housing 12 is closed off by means of a cover canopy 30 on which is centrally mounted an upper axle retainer bracket, generally designated at 31, and wherein an axle securing means 33 is centrally positioned in a lower axle support bracket, generally indicated at 34 which forms a part of base member 32. A rotary positioning means 35 and a locking means are indicated at 36 in FIGS. 3, 4, 5 and 6, all of which will hereinafter be described in more detail, Also seen in FIGS. 3 and 4 is a removable rear cover wall section, indicated at 38, which is to be used when the cabinet or cabinets are positioned along a wall of a room or when access is to be provided to only one of the two access openings 22 and 24. The rear cover wall section is removed when both access openings are to be used, as is illustrated in FIG. 1B. It should be also mentioned that one or both of the end walls 20 are removed when a multiplicity of file cabinets are interconnected, as illustrated in FIG. 1B. The arrangement of the contiguously positioned file cabinets shows that they have the rear sections 38 removed from the cabinet housing 12, so that complete access to both oppositely disposed access openings 22 and 24 is provided as mentioned above, and can thus be employed as a room divider if desired.

Figure 12:
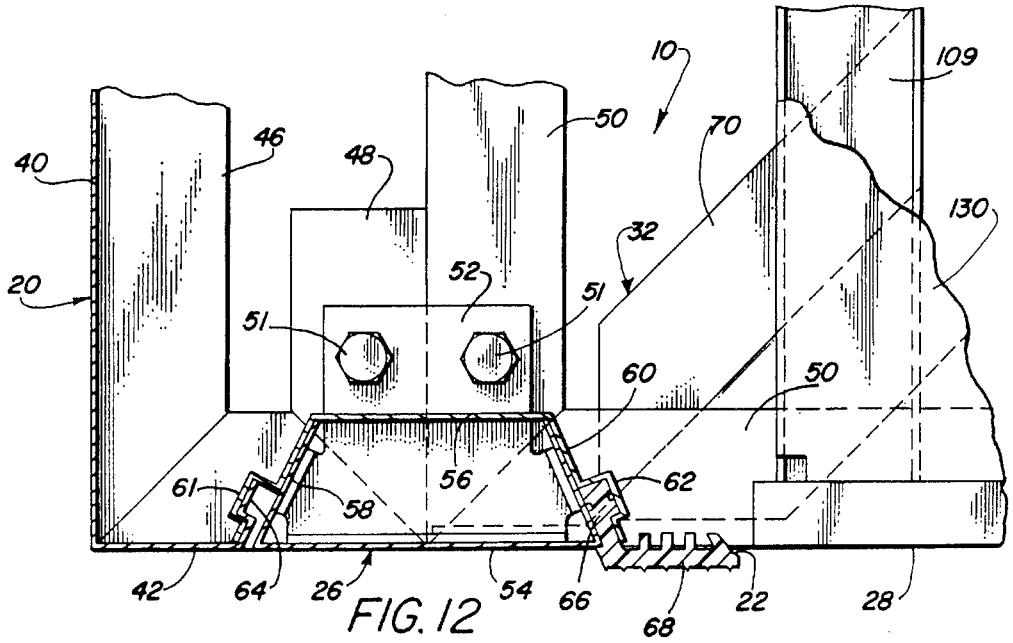
FIG. 12 is an enlarged cross-sectional view taken substantially along line 12—12 of FIG. 1A.

In FIGS. 1A and 2, each end wall 20 is shown being supported by and mounted on a bottom skirt 21. End wall 20 is formed with an enlarged end panel, generally indicated at 40, and inwardly bent side members 42 arranged to abut and interconnect with respective box-post members 26, as can be seen in FIG. 12.

Both the upper and lower edges of end panels 40 include inwardly bent flange members 44 and 46, respectively, as shown in FIG. 3. The upper flange member 44 is adapted to receive a narrow cover member 45, as seen in FIGS. 1A and 2. The terminating end 48 of bottom flange member 46 projects inwardly (see FIG. 12) and is adapted to be secured to a respective corresponding extended frame member 50 which is part of base member 32.

The bottom of post member 26 is provided with an attaching bracket 52 which is secured to the abutting end member 48 and frame member 50 by a suitable means which is herein shown as bolts 51. Each vertical post member 26 is formed as an elongated tubular box member having front and rear walls 54 and 56, and angularly displaced side walls 58 and 60, respectively, which are provided with a longitudinal securing means comprising clips 62 which are adapted to correspondingly receive and lock into place with either the longitudinal keeper edge 64 of the side panel 42 of end wall 20 or the keeper edge 66 of a vinyl molded strip 68.

Figure 13:
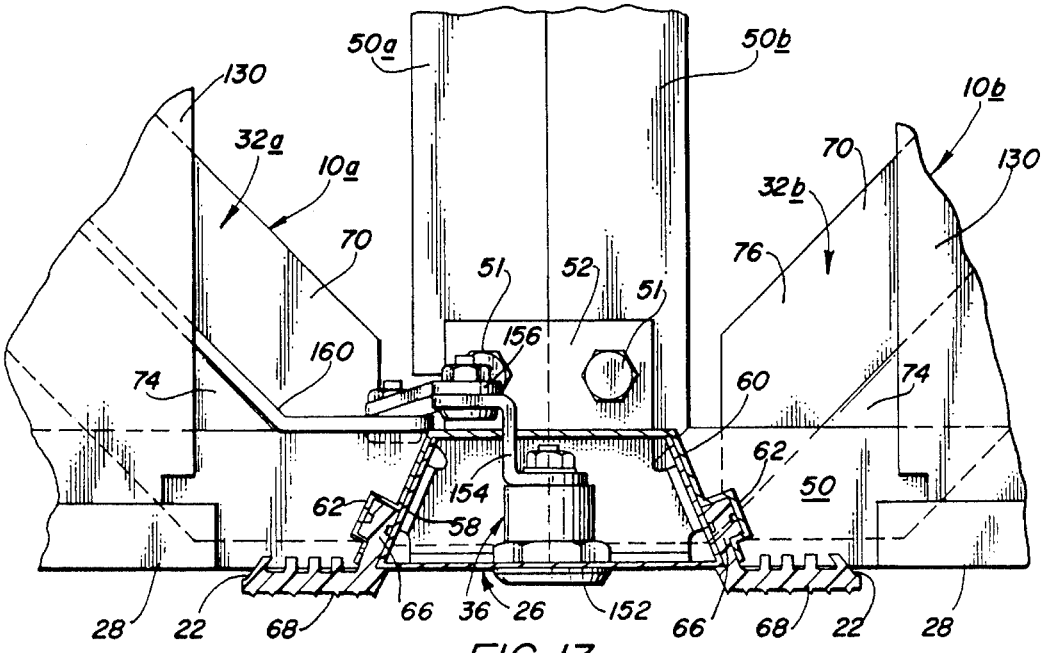
FIG. 13 is an enlarged cross-sectional view taken substantially along 13—13 of FIG. 1B.
Figure 14:
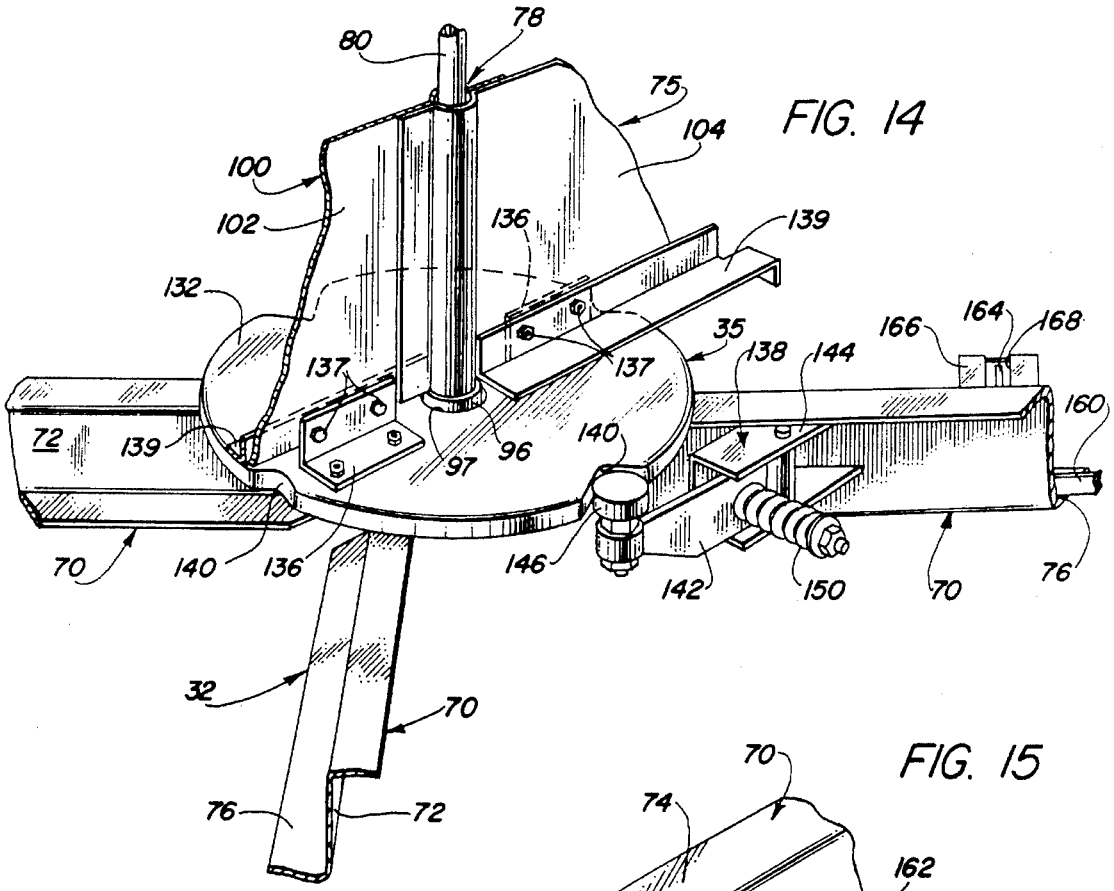
FIG. 14 is a perspective view of the rotary-positioning apparatus.

It should be noted that molded strips 68 together with post members 26 define access opening 22. The mounting of box post 26 between end wall 20 and flexible strip 68 is better shown in FIG. 12. However, in the sectional view of FIG. 13, which is taken from FIG. 1B, box post 26 is shown mounted so as to straddle the adjacent parts of each base member, whereby the post is interconnected between juxtaposed cabinet units 10*a* and 10*b*, strip 68 being secured in each oppositely positioned mounting clip 62. Attaching bracket 52 is attached to frame members 50*a* and 50*b* of the juxtaposed base member 32.

Not only does the base member 32 provide a means to support the walls of the cabinets, but it also provides the support base for rotary file assembly 14 which is centrally mounted thereon, whereby the rotary file assembly can be rotated 360 degrees in either clockwise or counterclockwise direction as may be required when opening the back-to-back, double-bay file sections 16 and 18.

Base member 32 comprises four support beams or leg members 70, each being preferably formed in a substantially Z-shaped, cross-sectional configuration defined by a vertical wall member 72, an upper outwardly extended flange member 74, and a lower flange member 76 that extends in an outward direction opposite from flange 74. Support beams or legs 70 are fixedly secured together by means of an axle support housing 34, as seen in FIGS. 3, 4, 5, 6 and 9, by a suitable means such as welding or the like. The beams 70 are attached together so as to form a substantially cross-like configuration with each beam extending outwardly lengthwise towards each respective corner of the file cabinet, the cross beam being enclosed in a box-like structure defined by frame members 50, as shown in FIG. 3. End walls 20, canopies 30 and box posts 26 of the cabinet structure are all secured together, whereby a very rigid lightweight cabinet is constructed to prevent twisting of the cabinet structure which occurs in other rotary file cabinets.

Rotary file assembly 14 is supported on base member 32 which includes a vertically mounted rotatable file frame assembly, generally indicated at 75. The file frame assembly is rotatably supported by means of an axle assembly 78 defined by an elongated vertical fixed axle or shaft 80 which is fixedly secured to axle support bracket 34 by means of a securing plug 82 that is fixedly secured in bottom wall 84 of support housing 34, as illustrated in FIG. 6.

The upper end of the hollow axle 80 is fixedly mounted in retainer bracket 31 that is mounted to the underside of canopy 30. Axle 80 is formed having a non-rotatable positioning member 86 which extends upwardly through a hole 88 formed in the bottom wall 89 of retainer bracket 31. Thus, central axle or shaft 80 is vertically fixed between retainer bracket 31 and axle support bracket.

Axle 80 is fixedly mounted within file frame assembly 75, which is rotatably supported on axle 80 by means of a first bushing 90 and a second bushing 92. Bushing 90 is a pilot bushing that is positioned adjacent the upper end of the axle. Bushing 92 defines a bearing mount and is formed with a flanged member 94 positioned adjacent the lower end of the axle 80.

Figure 6:
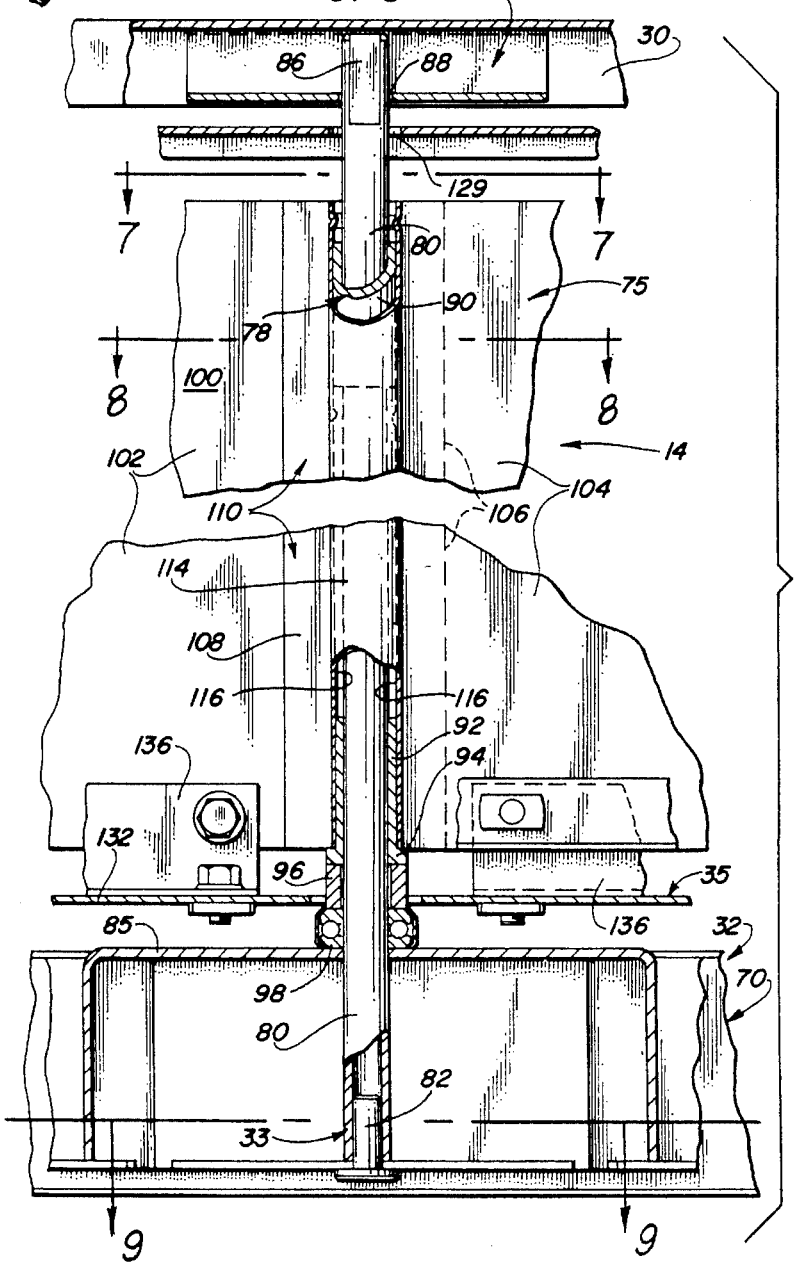
FIG. 6 is an enlarged vertical plan view of the rotatable coaxial support assembly taken in the direction of line 6—6 in FIG. 4 with the upper and lower portions thereof being broken away to show the mounting arrangement of the centrally positioned fixed shaft and the rotatable coaxial housing assembly, both of which are mounted between the top canopy and the base member of the cabinet.

Flanged member 94 engages a third bushing 96 located in a centrally positioned hole 97 formed in rotary positioning means 35, as seen in FIG. 6. This bearing assembly allows the file frame assembly 75 to be rotatably supported by a ball thrust bearing 98 that rests on the upper wall 85 of axle support housing 34.

Figure 5:
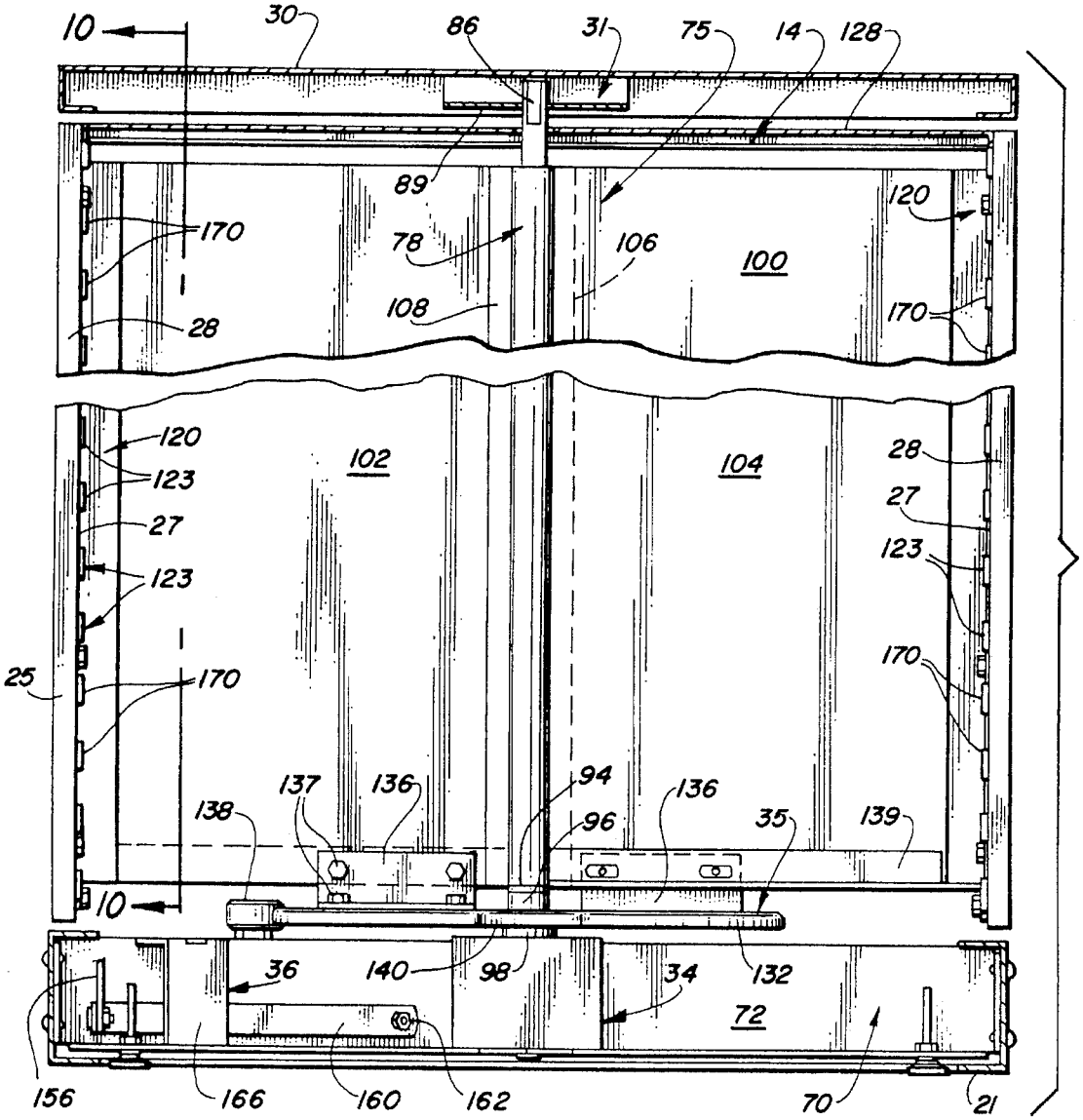
FIG. 5 is a cross-sectional view taken substantially along line 5—5 of FIG. 3 but without shelves being mounted therein so as to clearly show the framework of the rotary assembly.

The file frame assembly 75 is defined by a partition 100 that is interposed between and affixed to the oppositely disposed doors 28, as illustrated in FIGS. 3,4 and 5. Partition 100 is comprised of a pair of panels 102 and 104, respectively, which are arranged to be fixedly joined along their respective inner vertical edges 106 and 108 so as to define a solid sheet of metal that forms a single partition 100.

Both panels 102 and 104 are adapted to support the two oppositely positioned doors 28 and various file supporting shelves as well as slidable drawers or any suitable like devices for holding articles for storage and simple retrieval. However, to establish a stronger box-like frame structure a pair of bottom door ties or spacer bars 109 are formed as channel members and are secured to the oppositely positioned doors 28, as seen in FIG. 3.

Included as part of the file frame assembly 75 is a coaxial support housing, indicated generally at 110, which is coaxially mounted over axle assembly 78 which includes bushings 90 and 92 and axle 80, the file frame assembly being basically supported by the single thrust bearing 98. As an example, an E-3 series bearing manufactured by Aetna Bearing Company is very suitable for this purpose. This bearing provides a thrust-load capacity of 5325 pounds, whereas the maximum load on the file frame assembly of this novel bearing arrangement will reach less than 2000 pounds.

Accordingly, the axle assembly is basically fixed within the frame structure of the cabinet wherein the fixed axle is mounted in base 32 and is piloted at the top of the rotor by the use of the canopy top 30 and the four-corner post assembly, whereby ball thrust bearing 98, having a diameter of between 1 and 2 inches, defines a fulcrum point for the rotary file assembly.

Figure 7:
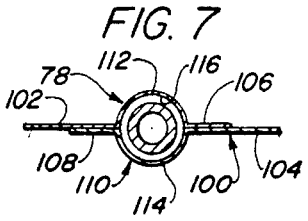
FIG. 7 is a top plan view of the coaxial support assembly taken substantially along line 7—7 of FIG. 6 thereof.
Figure 8:
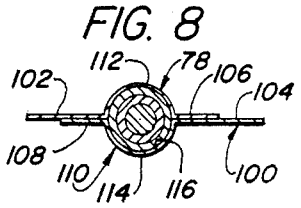
FIG. 8 is a cross-sectional view taken substantially along line 8—8 of FIG. 6 thereof.

The coaxial support housing assembly 110 is formed by the overlapping inner flanged edges 106 and 108 of the respective interconnected panels 102 and 104, as seen in FIGS. 6, 7 and 8. The overlapping flanged edges 106 and 108 are formed so as to define a rigid coaxial housing assembly 110 which comprises a pair of oppositely disposed housing sections 112 and 114.

Each housing section is formed with an elongated semicircular channel 116 that projects outwardly of partition 100. When the housing sections are interconnected, as illustrated in FIGS. 6, 7 and 8, the oppositely arranged channels define an elongated tubular structure in which is positioned the axle assembly 78 for rotatingly supporting the file frame assembly 75.

The structural arrangement of the two panels is to define the single partition 100 between the oppositely disposed file and/or storage bays 16 and 18, eliminating the need for additional frame members as disclosed in applicant's U.S. Pat. No. 5,312,181. Thus a stronger lighter weight rotatable file structure is provided.

Each opposite vertical edge of panels 102 and 104 is formed with a vertically disposed member 120 defined by a channel 121 that are fixedly secured by suitable means, such as bolts or welding, to an inner wall 27 of the double-walled door structure 28.

Figure 11:
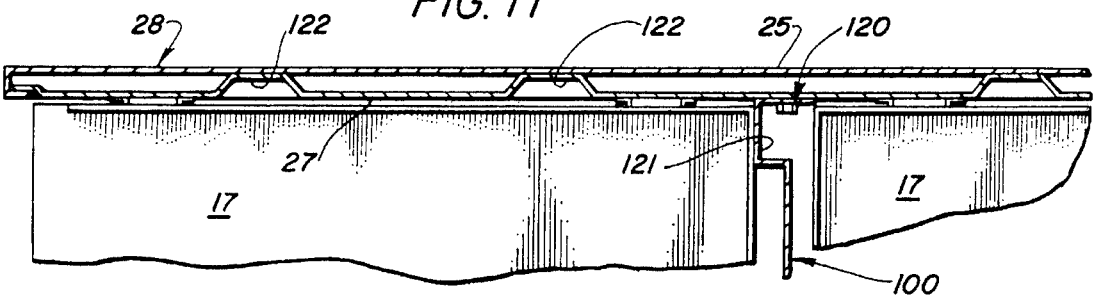
FIG. 11 is a cross-sectional view taken substantially along line 11—11 of FIG. 10.
Figure 10:
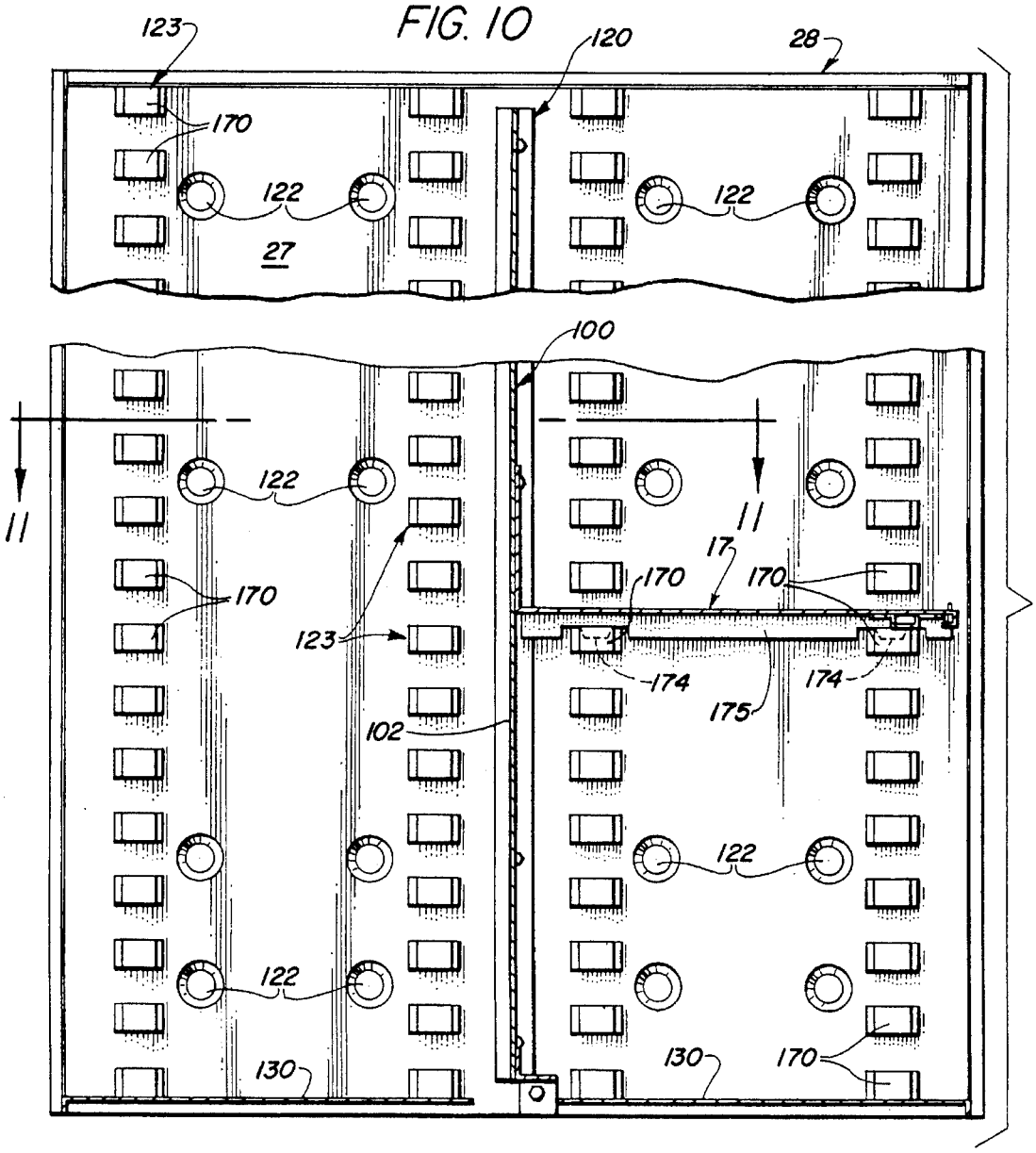
FIG. 10 is a cross-sectional view taken substantially along line 10—10 of FIG. 5, showing the shelf-mounting arrangement formed as part of the inner wall of the closure panels.

Partition 100 is further secured to the inner walls 27 of doors 28 by means of two horizontal strut members 139 which are secured to the lower end of each panel 102 and 104 also by bolts 137. Inner wall 27 is further formed with a plurality of inwardly projecting protrusions 122 to define spacers that are affixed to the outer wall by suitable welding, the protrusions providing a simple means to stiffen the door structure so as to strengthen the overall structure of each closure door 28. Inner wall 27 is also provided with a shelf-mounting means 123 for mounting and removing shelves 17, as indicated in FIGS. 10 and 11, or any other type of article supporting means that might be used in place of shelves 17.

File frame assembly 75 is further defined by a top cover panel 128 that is secured between the oppositely disposed closure doors. 28. The cover panel is provided with a centrally positioned hole 129 through which stationary positioning pin 86 passes into retainer housing 31 of canopy 30. The lower end of file frame assembly 75 includes a pair bottom closure covers 130, as illustrated in FIG. 2. The bottom closure covers 130 are positioned on both sides of the rotary support means and are fixedly mounted to the oppositely arranged closure doors 28 so as to cover base member 32 and rotary positioning means 35.

Figure 9:
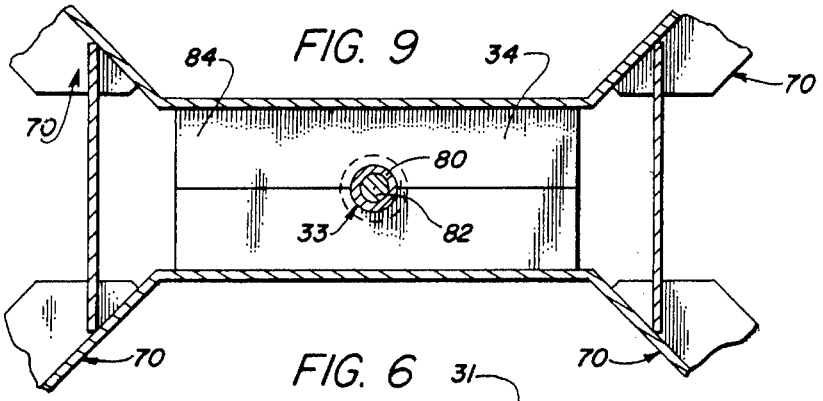
FIG. 9 is a cross-sectional view taken substantially along line 9—9 of FIG. 6 thereof.

Accordingly, rotary positioning means 35 which is interposed between base 32 and file frame assembly 75, and includes a locking means 36, comprises a circular positioning plate 132 having a central hole 134 formed therein to allow the lower end of fixed pole 80 to be positioned therethrough. Positioning plate 132 is fixedly mounted to the lower edge of partition panels 102 and 104 by means of depending brackets 136, as illustrated in FIGS. 5 and 9. Each bracket 136 is secured by means of bolts 137 to the respective panels 102 and 104, and circular positioning plate 132. Accordingly, circular plate 132 will rotate about fixed pole 80 as file-frame assembly 75 is selectively rotated to either an open or closed position.

In order to position rotary assembly 35 within the cabinet housing, positioning plate 132 is formed with four equally spaced recesses or semicircular grooves 140 that are located about the peripheral edge of plate 132. A keeper means, generally indicated at 138, is mounted to one of the four extended leg members 70 that define base 32.

The keeper means comprises a spring-loaded latch arm member 142 that is pivotally mounted to leg member 70 by means of a mounting bracket 144 which is secured to leg member 70. The free end of arm member 142 includes a roller 146 that engages the peripheral edge of plate 132 by means of biasing spring 148 that causes roller 146 to forcibly engage one of the aligned peripheral recesses as the file frame is rotated in either a clockwise or counterclockwise direction. The biasing force of spring 150 is sufficient to hold the rotatable file frame structure in place and yet allow one to readily rotate the rotary assembly with ease.

Figure 15:
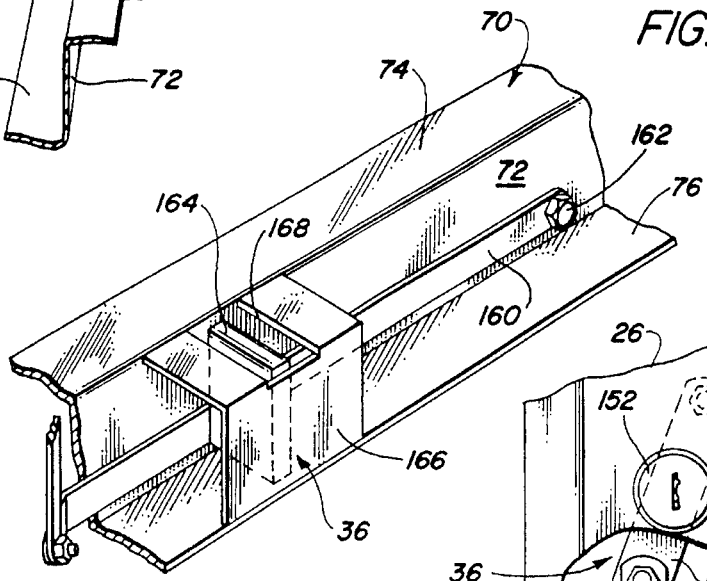
FIG. 15 is a perspective view of the rotary assembly locking apparatus.
Figure 16:
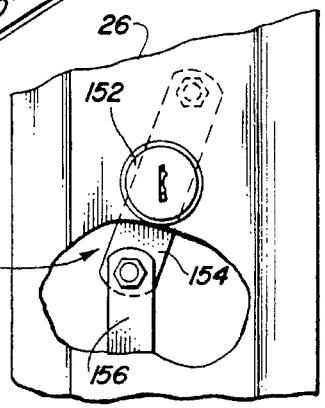
FIG. 16 is a view of the key lock that operates the locking apparatus structure.
Figure 17:
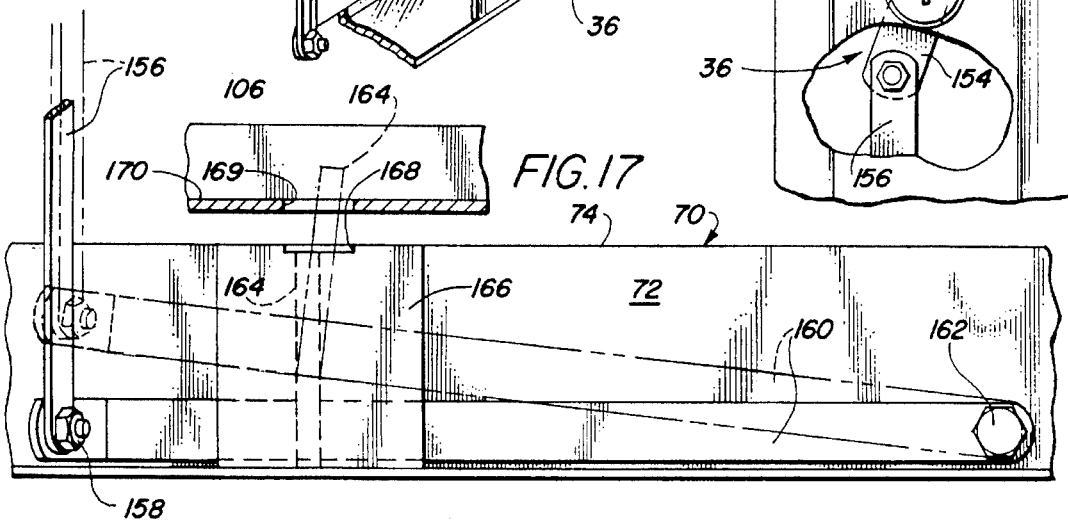
FIG. 17 is a side view of the rotary assembly locking apparatus shown engaging a locking bracket mounted to the underside of the rotary assembly framework.

Locking means 36 comprises a suitable key-lock assembly 152 mounted in one of the cabinet post members 26, as illustrated in FIGS. 1A, 1B and 16. Key-lock assembly 152 is provided with an arm member 154 to which is pivotally mounted a vertically disposed lever arm 156 that extends downwardly, as seen in FIGS. 15, 16 and 17. The lower terminating end of lever arm 156 is pivotally attached at one end of a latching arm 160, which is also pivotally attached at 162 to vertical wall member 72 of one of the base members 70.

A locking tongue 164 is fixedly secured to latching arm 160 and is enclosed in a box-frame member 166 having an opening 168 which allows locking tongue 164 to be raised therethrough so as to be engaged within an aligned opening 169 formed in the elongated channel member 109, as illustrated in FIG. 17. Channel member 109 is mounted adjacent the underside of each closure cover 130. The two openings 168 and 169 are aligned only when the file-frame structure is in a closed position. When a key is positioned in key-lock assembly 152 it can be operated to lock or unlock the rotor assembly 14. In an unlocked mode locking tongue 164 rests below opening 168 of box frame 166, and when in a locked position tongue 164 is raised so as to be received through openings 168 of housing 166 and opening 169 located in channel member 109.

Referring more particularly to the means 123 for mounting various types of shelving, there is illustrated in FIGS. 10 and 11 a plurality of vertically aligned tab members 170. Tab members 170 are formed on inner walls 27 and are horizontally formed to define vertical slots so as to receive corresponding vertical finger members 174 that project downwardly from the side wall 175 of shelf member 17. This arrangement between the respective slots and fingers establishes a very simple means of mounting and strongly supporting each shelf at any upper or lower location within the bay sections defined by the file-frame structure.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What I claim is:

1. An improved rotary file and storage cabinet having a cabinet housing defined by oppositely positioned side walls and oppositely disposed access openings on which is mounted a canopy, said cabinet housing being fixedly mounted to a base member, the improvement comprising:

a rotatable file assembly mounted between a canopy and a base member, wherein said rotatable file assembly comprises:

a pair of oppositely positioned doors;

a partition with outer ends interposed between said doors with said outer ends of said partition being secured to said doors, whereby a oppositely arranged storage compartment is defined on each side of said partition;

an axle assembly including a fixed axle mounted at one end to said canopy and affixed at the opposite end to said base member on which said rotatable file assembly is rotatably mounted;

means for vertically positioning said axle assembly and centrally locating said fixed axle within said cabinet housing;

means for fixedly securing said fixed axle to said base member;

a plurality of bearing members selectively mounted on said fixed axle so as to be interposed between said fixed axle and said rotatable file assembly, whereby said rotatable file assembly is rotatable about said fixed axle;

coaxial support means formed in the central portion of said partition to define a coaxial housing for said axle assembly, wherein said fixed axle and said bearing members are mounted within said coaxial housing, whereby said rotatable file assembly is selectively rotatable about said fixed axle;

positioning means mounted to said base member operably positioned between said rotatable file assembly and said base member.

2. An improved rotary file and storage cabinet as recited in claim 1, wherein said coaxial housing comprises:

an elongated tubular housing formed vertically within said partition formed to receive said axle assembly.

3. An improved rotary file and storage cabinet as recited in claim 2, wherein said partition comprises a first panel and a second panel wherein each of said panels has corresponding channels formed along the respective inner edges which overlap each other to define said elongated tubular housing in which said axle assembly is positioned.

4. An improved rotary file and storage cabinet as recited in claim 3, wherein bearing members comprise:

a first pilot bushing positioned adjacent the upper end of said axle and a second pilot bushing having a flanged member positioned adjacent the lower end of said axle;

a third pilot bushing positioned to engage said flange member of said second bushing; and an axle-support thrust bearing interposed between said third bushing and said base member.

5. An improved rotary file and storage cabinet as recited in claim 4, wherein said axle securing means comprises:

an upper axle-retainer bracket mounted to said canopy formed to receive the upper end of said axle which is defined as a non-rotatable positioning member; and a lower axle-support bracket formed as part of said base member in which said axle is fixedly secured thereto, whereby said rotatable file assembly rotates about the axis thereof.

6. An improved rotary file and storage cabinet as recited in claim 5, wherein said positioning means comprises:

a circular positioning plate having a central hole formed therein, the lower end of said axle being positioned therethrough, wherein said positioning plate is fixedly mounted to said partition and positioned above the base member, and wherein said peripheral edge of said plate is formed with four equally spaced apart recesses; and keeper means mounted to said base member and positioned to selectively engage each of said peripheral recesses as said file assembly is rotated about the axis of said axle, whereby said file assembly is selectively positioned between an open or closed mode.

7. An improved rotary file and storage cabinet as recited in claim 6, wherein said keeper means comprises:

an arm member pivotally mounted to said base member;

a roller mounted on the free end of said arm member to engage the peripheral edge of said positioning plate by means of a biasing spring so as to cause said roller to forcibly engage one of said peripheral recesses as said file assembly is rotated in either a clockwise or counterclockwise direction.

8. An improved rotary file and storage cabinet as recited in claim 7, wherein said base member comprises:

a plurality of interconnected angularly disposed beam members; and a four-sided frame member in which said beam members are fixedly mounted.

9. An improved rotary file and storage cabinet as recited in claim 2, wherein said oppositely disposed doors are interconnected at a lower end of each door by means of a pair of longitudinal strut members affixed to said partition.

10. An improved rotary file and storage cabinet as recited in claim 9, wherein said rotatable file assembly includes a pair of door ties formed as channel members which are interconnected and secured to said oppositely disposed doors.

11. A rotary file cabinet comprising:

a cabinet housing having a base member on which is mounted two oppositely disposed side walls and two oppositely disposed access openings, wherein each of said access openings is defined by a pair of vertical post members and a canopy fixedly mounted to each of said post members at the upper end of said post members and a base member on which is fixedly secured said vertical post members;

a rotary file assembly including an axle assembly centrally mounted in said cabinet between said canopy and said base member within said cabinet housing, said rotary file assembly being supported by a thrust bearing; and wherein said rotary file assembly includes a partition formed with outer edges and a centrally positioned coaxial support housing defined by an elongated tubular housing formed vertically within said partition to receive said axle assembly;

a pair of oppositely disposed doors affixed to the outer edges of said partition;

a pair of oppositely disposed storage bay sections defined by said partition and said doors;

means for vertically positioning said axle assembly within said cabinet housing and said coaxial support housing;

means for fixedly securing said axle assembly means between said canopy and said base member, whereby said axle assembly is prevented from rotating therein;

positioning means interposed between said support frame and said base member, whereby said rotary file assembly can be selectively positioned within said cabinet housing; and locking means mounted in said cabinet housing and arranged to lockingly engage said rotary file assembly when said closure doors are positioned in a closed mode.

12. A rotary file cabinet as recited in claim 11, wherein said partition comprises:

a first panel and a second panel wherein each of said panels has corresponding channels formed along the respective inner edges which are positioned to overlap each other to define said elongated tubular housing in which is positioned said axle assembly for rotatingly supporting the file-frame assembly; and means for securing said first and second panels together to form said partition having said tubular housing located therein.

13. A rotary file cabinet as recited in claim 12, wherein said axle assembly comprises:

a centrally disposed axle having a plurality of bushings mounted along the axis of said axle, wherein at least one bushing is positioned adjacent the upper end of said axle and a second bushing defines a bearing mount having a flanged member which is positioned adjacent the lower end of said axle;

a third bushing positioned to engage said flange member of said second bushing; and wherein said thrust bearing is interposed between said third bushing and said base member so as to rotatably support said rotary file assembly.

14. A rotary file cabinet as recited in claim 13, wherein said means for fixedly securing said axle assembly means between said canopy and said base member comprises:

an upper axle-retainer bracket mounted to said canopy formed to receive the upper end of said axle which is defined as a non-rotatable positioning member;

a lower-axle support bracket formed as part of said base member in which said axle is fixedly secured thereto, whereby said rotatable file assembly rotates about the axis thereof.

15. A rotary file cabinet as recited in claim 14, wherein each of said doors is formed with an outer panel and an inner panel, and wherein means are formed in said inner panels for removably mounting shelf members so as to adjustably locate one or more shelf members between the respectively positioned doors.

16. A rotary file cabinet as recited in claim 15, including means for contiguously interconnecting two or more cabinet housings, and including a rotatable file assembly.

17. A rotary file cabinet as recited in claim 11, wherein said rotatable file assembly includes a pair of door ties which are formed as channel members interconnected and secured to said oppositely disposed doors.

18. A rotary file cabinet as recited in claim 17, wherein said thrust bearing includes having a diameter of between 1 and 2 inches, that defines a fulcrum point for the rotary file assembly.

* * * * *